United States Patent [19]

Thul

[11] Patent Number: 4,537,310

[45] Date of Patent: Aug. 27, 1985

[54] TEAR-OFF PAD RAIL CLIP

[75] Inventor: James L. Thul, Plymouth, Minn.

[73] Assignee: The Press, Inc., Chanhassen, Minn.

[21] Appl. No.: 613,959

[22] Filed: May 23, 1984

[51] Int. Cl.[3] ..... B65D 85/00; G09F 1/00

[52] U.S. Cl. ..... 206/526; 40/10 R; 40/11 R; 40/23 A; 40/152.1; 206/806; 206/813

[58] Field of Search ..... 206/526, 813, 806; 248/467, 481, 479; 40/152.1, 10 R, 11 R, 23 A

[56] References Cited

U.S. PATENT DOCUMENTS

| | | | |
|---|---|---|---|
| 1,835,098 | 12/1931 | Shedd | 40/152.1 |
| 4,016,977 | 4/1977 | Krautsack . | |
| 4,152,851 | 5/1979 | Goldstein | 206/526 |
| 4,420,082 | 12/1983 | Bernie | 206/526 |

OTHER PUBLICATIONS

Channel Vue ® III Rail Clip by Conlan/Golden, Inc., described on page 2 of application, lines 4 through 23. Versa Clip TM Pad Holder Photograph, Photograph #3, Photograph #4.

*Primary Examiner*—William T. Dixson, Jr.
*Attorney, Agent, or Firm*—Merchant, Gould, Smith, Edell, Welter & Schmidt

[57] ABSTRACT

A tear-off pad and rail clip assembly (10) is disclosed. The assembly (10) includes a plurality of individual sheets (11*a*), each having a top edge. The sheets (11*a*) are cooperatively connected at their top edges to form a pad (11) having a top edge (12). A mounting plate (14) is constructed of a flexible resilient material and includes a tongue section (23). The mounting plate (14) is pivotally mounted to the pad (11). The plate (14) is rotatable between a down position and an up position. The plate (14), when in the down position, has a top side (18) having an apex position generally above the pivot and the top side (18) has generally downwardly depending segments (18*a*) and (18*b*), wherein the plate (14) is rotatable to an intermediate position between the up and down positions, wherein the top side (18) of the plate (14) is below the top edge (12) of the pad (11) when in the intermediate position.

15 Claims, 2 Drawing Figures

TEAR-OFF PAD RAIL CLIP

BACKGROUND OF THE INVENTION

1. Field of the Invention

This invention relates generally to a rail clip for supporting a pad of sheet-like items to be dispensed one at a time, and more particularly to a rail clip assembly that supports a pad in a plurality of manners and provides for ease of shipping the pads and rail clip in an assembled condition.

2. Description of the Prior Art

Tear-off pads having a plurality of individual sheets, such as refund coupons, are frequently displayed in grocery stores, drug stores or similar retail shops. Unless adequately supported during their display, the pad of coupons will become damaged or will fall away from the desired support. Further, there are different methods of displaying the coupons, depending on the particular store. Therefore, it is necessary to have a sturdy and versatile mounting clip available.

Several types of mounting clips are presently available. One example of this is shown in U.S. Pat. No. 4,016,977, issued Richard Krautsack. The Krautsack support includes a head section and a base section. The head section has a pair of ears formed therein and the base section carries a pressure sensitive adhesive with a release liner. A pivot links the sheet-like items to the support such that when rotated, either the base section or head section is above the top edge of the sheet-like items.

In addition, there have been similar supports that have a center tongue section as compared to two outer ear sections, as that of the Krautsack support.

One of the major disadvantages of the previously prior art clips is that when the pad and clip are assembled, the clip extends above the top portion of the pad. Therefore, there is not a neat, rectangular item to be packed. The clip protrudes above the pad of coupons. This makes it very difficult to properly pack the coupons without subsequent damage during shipping.

This problem was addressed in another rail-clip support by Conlan/Golden, Inc. in Davenport, Iowa. Their clip placed the adhesive strip on the same section as the tongue. Therefore, when the clip was rotated in its down position, there was no extension beyond the top edge of the pad of coupons. However, the top edge of the clip, when in the down position, ran parallel to the pad of coupons. Therefore, any rotation of the clip would cause the top edge of the clip to extend beyond the top edge of the pad. This created problems with the assembly of the clip to the pad and subsequent shipping. It was necessary to have the clip properly oriented so as to not have the top edge of the clip extend beyond the top edge of the pad after assembly and before packaging. Further, the tongue member that was formed in the clip was formed by a horizontal cut and two semicircular cuts at each end of the horizontal cut. The combination of the horizontal cut and two semicircular cuts did not provide for a well defined tongue area for subsequent insertion into the rail.

The present invention addresses the problems associated with the prior art devices and provides for a new and improved tear-off pad rail clip assembly.

SUMMARY OF THE INVENTION

The present invention is a tear-off pad and rail clip assembly. The assembly includes a plurality of individual sheets, each having a top edge. The sheets are cooperatively connected at their top edge to form a pad having a top edge. Also included is a mounting plate of a flexible, resilient material and means for forming a tongue section in the mounting plate. The mounting plate is pivotally mounted to the pad. The plate is rotatable between a down position and an up position. The plate, when in the down position, has a top side having an apex position generally above the pivot and the top side has generally downwardly depending segments, wherein the plate is rotatable to an intermediate position between the up and down positions, wherein the top side of the plate is below the top edge of the pad when in the intermediate position.

In a preferred embodiment the assembly further comprises a strip of pressure sensitive adhesive cooperatively connected to the mounting plate and a release paper covering the adhesive. Preferably, the adhesive and release paper are transparent.

DETAILED DESCRIPTION OF A PREFERRED EMBODIMENT

Figure 1:
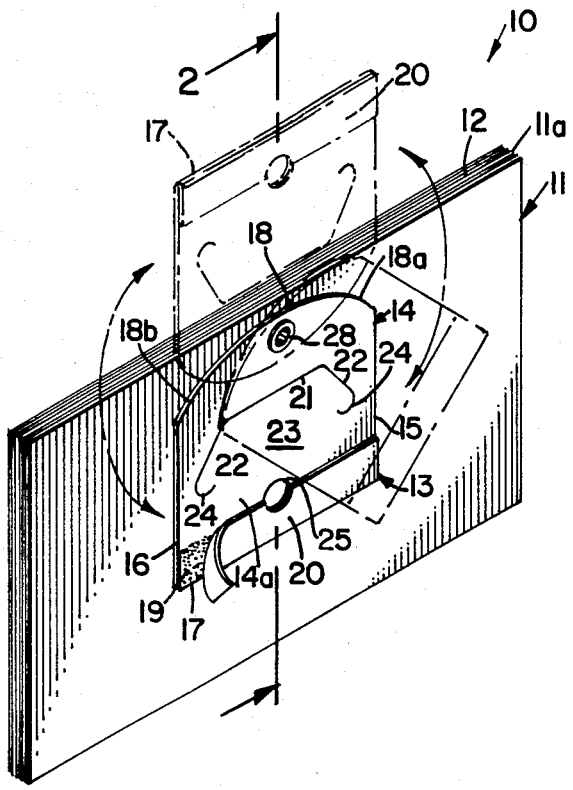
FIG. 1 is a perspective view of the apparatus embodying the present invention.

Referring to the drawings, wherein like numerals represent like parts throughout the several views, there is generally disclosed at 10, a tear-off pad and rail clip assembly. The assembly 10 includes a pad 11 having a plurality of individual sheets 11*a* cooperatively connected at a top edge 12 of the pad 11. It is well known in the art how to assemble such a pad of individual sheets. The individual sheets 11*a* are easily removed one at a time by tearing off the sheets 11*a* from the top edge 12.

The assembly 10 also includes a rail clip, generally designated as 13. The rail clip 13 includes a mounting plate 14. The mounting plate 14, having a first surface 14*a* and a second surface 14*b*, is bounded by a first side 15, second side 16, third side 17, and fourth side 18. The first, second and third sides 15, 16 and 17 are generally straight, but it is understood that other suitable configurations may also be used. The fourth side 18 has a first segment 18*a* and a second segment 18*b*. As viewed in FIG. 1, the first segment 18*a* joins the second segment 18*b* at the apex of the fourth side 18. While it is illustrated in FIG. 1 that the segments 18*a* and 18*b* are curved, it is also understood that other configurations may be used. From the apex of the fourth side 18, the first segment 18*a* extends toward the first side 15 in a generally downward direction toward the third side 17. Similarly, the second segment 18*b* extends towards the second side 16 in a generally downward direction toward the third side 17. As will be more fully discussed hereafter, the generally downward sloping of the segments 18*a* and 18*b* provide for advantages over that of the prior art. Therefore, other configurations, such as straight segments for 18*a* and 18*b* may be used as long as they are generally downwardly sloping from the apex of side 18.

A pressure sensitive adhesive 19 is coated on the first surface 14*a* along a strip proximate the third side 17. The pressure sensitive adhesive 19 is covered by a release paper 20. In FIG. 1, the release paper 20 is shown partially removed. While in a preferred embodiment, the paper 20 is transparent. One example of a nontransparent tape is a 465 Transfer Tape by 3M of St. Paul, Minn.

A generally horizontal cut 21 having generally downwardly depending end cuts 22 are formed in the mounting plate 14. The cuts 21 and 22 extend through the mounting plate 14 from the first surface 14*a* to the second surface 14*b*. The cuts 21 and 22 do not extend to the sides of the mounting plate and form a tongue section 23. The end cuts 22 form an obtuse angle with the horizontal cut 21. The end cuts 22 terminate with a curled cut 24. The curled cut 24 relieves stress in the mounting plate 14. It is also understood that other methods of relieving stress, such as forming a hole at the end of the end cuts 22 may be used. A first opening 25 is formed in the mounting plate 14 proximate the third side 17. A second opening 26 is formed in the supporting plate 14 proximate the fourth side 18 and generally directly below the apex of the fourth side 18. Both openings 25 and 26 are located generally equidistant from the first and second sides 15 and 16.

The sheets 11*a* have aligned holes 27 located proximate the top edge 12 of the pad 11. To assemble the rail clip 13 to the pad 11, a rivet 28 is inserted through the hole 27 and opening 26 and appropriately crimped to fasten the pad 11 to the rail clip 13. The rail clip 13 is free to pivot around the rivet 28 as shown by the arrows in FIG. 1.

When the pad 11 is initially assembled to the rail clip 13, the rail clip is in a "down" position as shown in solid lines in FIG. 1. During use, it is rotated to a "up" position as shown in phantom lines in FIG. 1 and as in FIG. 2. As previously discussed, it is important that the rail clip 13 be positioned beneath the top edge 12 of the pad 11 during shipment. When the rail clip 13 is positioned beneath the top edge of the pad 11, the outer configuration of the assembly 10 is that of the pad 11. The outer configuration of the pad 11 is generally a rectangle that can easily be packaged in a box or shipping carton. This provides for ease of shipment as well as less damage to the pad 11 during shipment. Also shown in phantom lines if FIG. 1 is an intermediate position between the down and up positions. In this intermediate position, the rail clip 13 is still below the top surface 12 of the pad 11. The downwardly depending segments 18*a* and 18*b* allow the rail clip 13 to be pivoted around the rivet 28 to the intermediate position without the fourth side 18 extending above the top edge 12 of the pad 11. This freedom to pivot to the intermediate position without extending above the pad 11 allows for a less critical assembly of the rail clip 13 to the pad 11. The rail clip 13 no longer has to be in a completely vertical position as with the prior art to prevent the top edge 18 from extending above the top edge 12 of the pad 11. This allows for some rotation of the clip 14 without changing the outer configuration of the assembly 10 to be different than the pad 11, better packaging and not creating damage to the pad 11 during shipment. The rail clip 13 no longer has to be exactly centered for packaging and shipment. The present invention provides for an intermediate position that can include up to a 45° rotation from the down position, before the fourth side 18 extends above the top edge 12 of the pad 11.

The curled end cuts 24 direct any crack that may be developed extending along the end cuts 22 back and towards the center of the plate 14.

Figure 2:
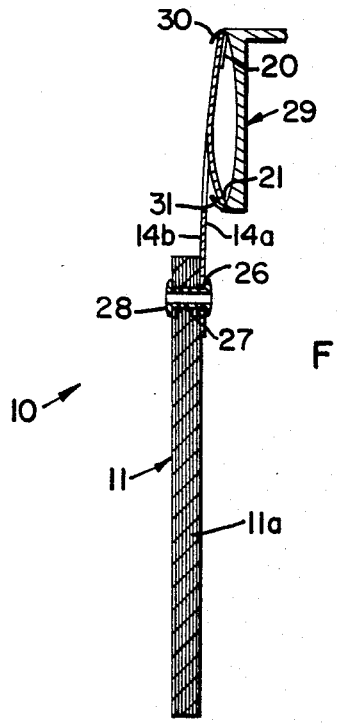
FIG. 2 is a cross-sectional view of the present invention, as shown in FIG. 1, taken generally along the lines 2—2.

The mounting of the assembly 10 to a rail 29 is shown in FIG. 2. The rail 29 has a top flange 30 and a bottom flange 31. The rail clip 13 is rotated to its up position. The third side 17 is then inserted under the top flange 30. The tongue 23 is pushed out of the plane of the mounting plate 14 and inserted into the bottom flange 31. The distance between the third side 17 and the horizontal cut 21 is greater than the distance between the top flange 30 and bottom flange 31. The plate 14 is made of a flexible material, such as high density polyethylene that has a thickness from 0.020 inches to 0.040 inches, preferably with a thickness of 0.030 inches. After the tongue 23 has been inserted in the bottom flange 31, pressure is applied to the backplate 14 causing the backplate 14 to snap over center and conform to the arcuate configuration of the rail 29.

In addition to being able to be fastened to a rail, the rail clip 13 may also be supported against a flat surface by simply removing the release tape 20 and pressing the rail clip 13 against the flat surface, such that the pressure sensitive adhesive 17 adheres to the flat surface. In a preferred embodiment, the release paper 20 and pressure sensitive adhesive 19 are transparent.

Another method of securing the rail clip 13 is to simply rotate the clip 13 to its up position and support the clip on a peg through the opening 25. Still another method of securing the clip 13 is to keep the clip 13 in its down position and gently pull the third side 17 away from the sheets 11. An edge of the carton is then inserted between the sheets 11 and rail clip 13 to support the assembly 10.

Other modifications of the invention will be apparent to those skilled in the art in light of the foregoing description. This description is intended to provide specific examples of individual embodiments which clearly disclose the present invention. Accordingly, the inventions not limited to these embodiments or the use of elements having specific configurations and shapes as presented herein. All alternative modifications and variations of the present invention which follows in the spirit and broad scope of the appended claims are included.

What is claimed is:

1. A tear off pad and rail clip assembly comprising:

(a) a plurality of individual sheets each having a top edge, said sheets cooperatively connected at said top edge to form a pad having a top edge;

(b) a mounting plate of a flexible, resilient material, said mounting plate having a mounting hole formed therein, whereby when said mounting plate is rotated to an up position, said assembly may be supported from a hook positioned through said mounting hole;

(c) a strip of pressure sensitive adhesive cooperatively connected to said mounting plate and a release paper covering said adhesive;

(d) means for forming a tongue section in said mounting plate;

(e) means for pivotally mounting said plate to said pad, said plate being rotatable between a down position and an up position, wherein when in the up position, said mounting hole, tongue section and adhesive are all positioned above said pivotally mounting means; and (f) said plate, when in said down position, having a top side having an apex positioned generally above said pivot means and said top side having generally downwardly depending segments, wherein said plate is rotatable to an intermediate position between said up and down positions, wherein said top side of said plate is below said top edge of said pad when in said intermediate position.

2. The assembly of claim 1, wherein said adhesive and said release paper are transparent.

3. The assembly of claim 1, wherein said mounting plate is constructed of high density polyethylene.

4. The assembly of claim 1, wherein said mounting plate is between 0.020 inches and 0.040 inches in thickness.

5. The assembly of claim 4, wherein said mounting plate is 0.030 inches in thickness.

6. The assembly of claim 1, wherein said tongue forming means comprises a horizontal cut through said mounting plate and downwardly depending end cuts connected to said horizontal cut.

7. The assembly of claim 6, further comprising a curl cut cooperatively connected to said end cut to direct any crack that may develop on the end cuts into said mounting plate.

8. The assembly of claim 1, wherein said mounting plate is in said intermediate position after a rotation from said down position of up to 45 degrees.

9. A tear-off pad and rail clip assembly comprising:

(a) a plurality of individual sheets, each having a top edge, said sheets cooperatively connected at said top edge to form a pad having a top edge;

(b) a mounting plate of a flexible, resilient material, said mounting plate having a mounting hole formed therein, whereby when said mounting plate is rotated to an up position, said assembly may be supported from a hook positioned through said mounting hole;

(c) a horizontal cut through said mounting plate and downwardly depending end cuts connected to said horizontal cut forming a tongue section in said mounting plate;

(d) means for pivotally mounting said plate to said pad, said plate being rotatable between a down position and an up position, wherein when in the up position, said mounting hole, tongue section and adhesive are all positioned above said pivotally mounting means;

(e) a strip of pressure sensitive adhesive cooperatively connected to said mounting plate and a release paper covering said adhesive;

(f) said mounting plate having a mounting hole formed therein, whereby when said mounting plate is rotated to said up position, said assembly may be supported from a hook position through said mounting hole;

(g) said mounting plate is constructed of high density polyethylene and has a thickness between 0.020 inches and 0.040 inches; and (h) said plate, when in said down position, having a top side having an apex positioned generally above said pivot means and said top side having generally downwardly depending segments, wherein said plate is rotatable to an intermediate position between said up and down positions, wherein said top side of said plate is below said top edge of said pad when in said intermediate position, wherein said mounting plate is in said intermediate position after a rotation from said down position of up to 45 degrees.

10. A mounting clip for supporting a pad of sheetlike items from either a price channel having a top and bottom flange or against a vertical surface of a wall or the like, the pad having a top edge, said mounting clip comprising:

(a) a mounting plate of a flexible, resilient material, said mounting plate having a mounting hole formed therein, whereby when said mounting plate is rotated to an up position, said clip assembly may be supported from a hook positioned through said mounting hole;

(b) means for forming a tongue section in said mounting plate;

(c) a strip of pressure sensitive adhesive cooperatively connected to said mounting plate and a release paper covering said adhesive;

(d) means for pivotally mounting said plate to the pad, said plate being rotatable between a down position and an up position, wherein when in the up position, said mounting hole, tongue section and adhesive are all positioned above said pivotally mounting means; and (e) said plate, when in said down position, having a top side having an apex positioned generally above said pivot means and said top side having generally downwardly depending segments, wherein said plate is rotatable to an intermediate position between said up and down positions, wherein said top side of said plate is below said top edge of said pad when in said intermediate position.

11. The mounting clip of claim 10, wherein said tongue forming means comprises a horizontal cut through said mounting plate and downwardly depending end cuts connected to said horizontal cut.

12. The mounting clip of claim 11, wherein said end cuts and said horizontal cut form an obtuse angle.

13. The mounting clip of claim 10, wherein said mounting wherein said mounting plate is between 0.020 inches and 0.040 inches in thickness.

14. The mounting clip of claim 10, wherein said mounting plate is in said intermediate position after a rotation from said down position of up to 45 degrees.

15. A mounting clip for supporting a pad of sheetlike items from either a price channel having a top and bottom flange or against a vertical surface of a wall or the like, the pad having a top edge, said mounting clip comprising:

(a) a mounting plate of a flexible, resilient material;

(b) a horizontal cut through said mounting plate and downwardly depending end cuts connected to said horizontal cut, forming a tongue section in said mounting plate;

(c) means for pivotally mounting said plate to the pad, said plate being rotatable between a down position and an up position; and (d) a strip of pressure sensitive adhesive cooperatively connected to said mounting plate and a release paper covering said adhesive;

(e) said mounting plate having a mounting hole formed therein, whereby when said mounting plate is rotated to said up position, said assembly may be supported from a hook position through said mounting hole and when in said up position, said mounting hole, tongue section and adhesive are all positioned above said pivotally mounting means;

(f) said mounting plate is constructed of high density polyethylene and has a thickness between 0.020 inches and 0.040 inches; and (g) said plate, when in said down position, having a top side having an apex positioned generally above said pivot means and said top side having generally downwardly depending segments, wherein said plate is rotatable to an intermediate position between said up and down positions, wherein said top side of said plate is below said top edge of said pad when in said intermediate position, wherein said mounting plate is in said intermediate position after a rotation from said down position of up to 45°.

* * * * *